US005710481A

United States Patent [19]

Park et al.

[11] Patent Number: 5,710,481

[45] Date of Patent: Jan. 20, 1998

[54] CRT ELECTRON GUN FOR CONTROLLING DIVERGENCE ANGLE OF ELECTRON BEAMS ACCORDING TO INTENSITY OF CURRENT

[75] Inventors: Myung Ho Park, Seoul; Jin Yeal Choi, Youngcheon, both of Rep. of Korea

[73] Assignee: Goldstar Co., Ltd., Seoul, Rep. of Korea

[21] Appl. No.: 756,589

[22] Filed: Nov. 27, 1996

Related U.S. Application Data

[63] Continuation of Ser. No. 300,453, Sep. 2, 1994, abandoned.

[30] Foreign Application Priority Data

Sep. 4, 1993 [KR] Rep. of Korea ..... 17752/1993

[51] Int. Cl.[6] ..... H01J 29/50

[52] U.S. Cl. ..... 313/414; 315/382

[58] Field of Search ..... 313/44; 315/382

[56] References Cited

U.S. PATENT DOCUMENTS

| | | | |
|---|---|---|---|
| 4,442,458 | 4/1984 | Barker | 348/380 |
| 4,922,166 | 5/1990 | Ichida et al. | 313/414 |
| 5,025,189 | 6/1991 | Son | 313/414 |
| 5,036,258 | 7/1991 | Chen et al. | 315/382 |
| 5,061,881 | 10/1991 | Suzuki et al. | 315/382 |
| 5,063,326 | 11/1991 | Cho | 313/414 |
| 5,142,190 | 8/1992 | Koh | 313/414 |
| 5,164,640 | 11/1992 | Son et al. | 315/382 |
| 5,281,892 | 1/1994 | Kweon et al. | 313/414 |
| 5,347,202 | 9/1994 | Stil | 315/382 |

*Primary Examiner*—Mark R. Powell
*Assistant Examiner*—Lawrence D. Richardson
*Attorney, Agent, or Firm*—Fish & Richardson P.C.

[57] ABSTRACT

This invention relates to an inline electron gun for a color cathode ray tube, more particularly to an inline electron gun which can provide high resolution by controlling intensity of electrostatic lenses that controls electron beams according to intensity of current, dynamically.

The electron gun for a cathode ray tube includes a three electrode part having a part formed of a plurality of inline electron beam emitting means for emitting electron beams and the other part formed of control electrodes and acceleration electrodes for controlling quantity of the emission and forming a crossover of the electron beams, a plurality of focusing electrodes and positive electrodes forming a main electrostatic focusing lenses for focusing the electron beam onto a screen, the electron beam emitting means and the plurality of electrodes are aligned in line with the tube axis spaced in a certain interval, successively, and a supplementary electrode having a fixed thickness and synchronizing to application signal of the electron beam emitting means, the supplementary electrode is positioned between the acceleration electrode and the focusing electrode adjacent to the acceleration electrode and is for forming an enlargement electrostatic lens for controlling the divergence angle of the electron beam according to the intensity of current.

3 Claims, 7 Drawing Sheets

CRT ELECTRON GUN FOR CONTROLLING DIVERGENCE ANGLE OF ELECTRON BEAMS ACCORDING TO INTENSITY OF CURRENT

This application is a continuation of U.S. application Ser. No. 08/300,453, filed Sep. 2, 1994, now abandoned.

FIELD OF THE INVENTION

This invention relates to an inline electron gun for a color cathode ray tube, more particularly to an inline electron gun which can provide high resolution by controlling intensity of electrostatic lenses that controls electron beams according to intensity of current, dynamically.

DESCRIPTION OF THE PRIOR ART

AS shown in FIG. 1, a prior art electron gun includes a cathode 1 for discharging electron beams, a control electrodes 2 for controlling discharge of electrons, a first acceleration electrode 3 for accelerating the electron beams toward a screen, and an arrangement of many electrodes having at least two focusing lenses 4 and a second acceleration electrode 5. And the control electrode 2 in general grounded and the first acceleration electrode 3 having a voltage of 300 to 1000V applied thereto form an electron beam forming region. And the focusing electrodes 4 and the second acceleration electrode 5, having a focusing voltage (Vf ; 5000 to 9000 V) and an accelerating voltage (Vg; 20000 to 32000V) applied thereto respectively, form a main electrostatic lens 9.

The electron beam emitted from the cathode 1 starts to diverge at a crossover 7 near the first acceleration electrode 3.

The diverged electron beam is focused primarily by the electrostatic lens formed of a potential difference between the first acceleration electrode 3 and the focusing electrode 4, i.e., by the prefocusing lens 8, and forms small pixel on the screen 6 by the main electrostatic lens 9.

In the foregoing prior art electron gun, electrons are controlled by a cathode voltage Vc having an amplitude varying as a function of time and discharged through the cathode 1 as heat, and the intensity of current is determined by configuration of the electron beam forming regions and voltages applied to the cathode and various electrodes. Accordingly, the electrons form the crossover 7 and starts to diverge therefrom. The diverged electrons are focused primarily by the prefocusing lens formed of the potential difference between the first acceleration electrode 3 and the focusing electrode 4 and, again by the main electrostatic lens 9 to form a small beam spot on the screen.

The beam, i.e., a spot size, has very close relationship with a resolution of a CRT, and in general the resolution can be improved the smaller the spot size is. Major factors related with the spot size are arrangement of the main lens, spherical astigmation, a space charge exerting force on the electrons in a free space between the electron gun and the screen. These factors have very close relationship with a divergence angle of an electron beam incident to the main electrostatic lens 9 at a fixed angle shown in FIG. 2.

That is, the spot size Dx due to the main lens magnification M has a relation of Dx=Mdx to a size dx of a virtual image 11 obtained by extrapolation of the divergence angle, and the spot size Dsa due to the spherical astigmation has a relation of $Dsa=Cs\alpha^3$ to a spherical astigmation coefficient Cs and the divergence angle $\alpha$. The spot size Dsc due to the space charge in connection with current intensity I, thickness of the beam Db in the main lens, distance L from the main lens to the screen, maximum voltage Va at a positive pole, and a constant $\beta$ for electrons moving in a vacuum electric field can be expressed as $$Dsc=0.8\beta IL^2/DbVa^3{}_2.$$

Overall spot size Dt determined by the above equations can be expressed as $Dt=\sqrt{((Dx+Dsc)^2+Dsa^{2})}$ and the divergence angle which can make the overall spot size to the smallest is called an optimum divergence angle $\alpha_O$. Shown in FIG. 3 is the optimum divergence angle $\alpha_O$, wherein the abscissa and the ordinate represent the divergence angle $\alpha_O$ and the spot size D, respectively. FIG. 3 shows that the overall spot size Dt is determined by the spot size Dx owing to the arrangement of the main lens, the spot size Dsa owing to the spherical astigmation, and the spot size Dsc owing to the space charge, and that the divergence angle of the abscissa making the spot size the smallest is the optimum divergence angle $\alpha_O$.

FIG. 4 is a graph showing the optimum divergence angle as a function of the intensity of current, wherein optimum divergence angles $\alpha_{o1}$, $\alpha_{o2}$ and $\alpha_{o3}$ at various intensities of current 1 mA, 2 mA and 3 mA and increase of the spot sizes $Do_1$, $Do_2$ and $Do_3$ according to increase of the intensity of current 1 mA, 2 mA and 3 mA can be seen. FIG. 5 shows change of divergence angle Ao and change of optimum divergence angle Bo as a function of intensity of current in a prior art electron gun, wherein it can be seen that deviation of divergence angle from optimum divergence angle becomes more greater at higher intensity of current over 1 mA for the electrons in a prior art electron gun resulting in degradation of spot size. That is, when an electron gun has been designed to an optimum divergence angle at a specific intensity of current, the electron gun does not work at an optimum angle in other intensity of current.

Therefore, because the divergence angle increases very sharply as the intensity of current increases in the prior art electron gun, the magnification of the main lens should be changed according to the intensity of current. Consequently, because the voltage of the focusing electrode should be changed according to the intensity of current due to the foregoing reasons, the prior art electron gun has had problem of high production Cost and requiring additional electrodes.

SUMMARY OF THE INVENTION

The object of this invention is designed for solving the foregoing problems.

These and other objects and features of this invention can be achieved by providing an electron gun for a cathode ray tube including a three electrode part having a part formed of a plurality of inline electron beam emitting means for emitting electron beams and the other part formed of control electrodes and an acceleration electrode for controlling quantity of the emission and forming a crossover of the electron beams, a plurality of focusing electrodes and positive electrodes forming a main electrostatic focusing lens for focusing the electron beams onto a screen, and a supplementary electrode having a fixed thickness and synchronizing to application signal of the electron beam emitting means positioned between the acceleration electrode and the focusing electrode adjacent to the acceleration electrode, for forming an enlargement electrostatic lens to control the divergence angle of the electron beam according to the intensity of current, and the electron beam emitting means and the plurality of electrodes are aligned in line with the tube axis spaced in a certain interval successively. Alternatively, the plurality of focusing electrodes may include a first focusing electrode and a second focusing electrode adjacent to the positive electrode for applying same voltage, and a fixed thickness supplementary electrode positioned between the first focusing electrode and the second focusing electrode synchronized to the application signal of the electron beam emission means.

BRIEF DESCRIPTION OF THE DRAWINGS

FIGS. 8*a* to 8*c* are detail of a cathode dynamic electrode of the electron gun in accordance with this invention, wherein FIG. 8*a* is a plan view, FIG. 8*b* is a section across line A-A' of FIG. 8*a*, and FIG. 8*c* is a section across line B-B' of FIG. 8*a*.

FIGS. 10*a* and 10*b* are comparison graphs as a function of intensity of current when the cathode dynamic electrode of the electron gun of this invention is inserted between a first acceleration electrode and a focusing electrode, wherein FIG. 10*a* is a comparison of divergence angle as a function of intensity of current, and FIG. 10*b* is a comparison of spot size as a function of intensity of current.

FIGS. 11*a* and 11*b* are comparison graphs as a function of intensity of current when the cathode dynamic electrode of the electron gun of this invention is inserted between a first focusing electrode and a second focusing electrode, wherein FIG. 11*a* is a comparison of divergence angle as a function of intensity of current, and FIG. 11*b* is a comparison of spot size as a function of intensity of current.

DETAILED DESCRIPTION OF THE EMBODIMENT

This invention is to be explained in detail hereinafter, referring to the attached drawings.

Figure 1:
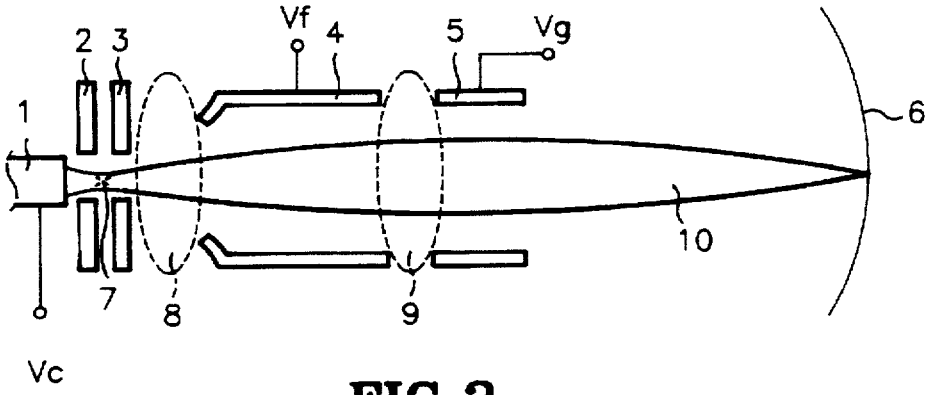
FIG.1 PRIOR ART
FIG. 1 is a section of a part of a prior art electron gun.
Figure 2:
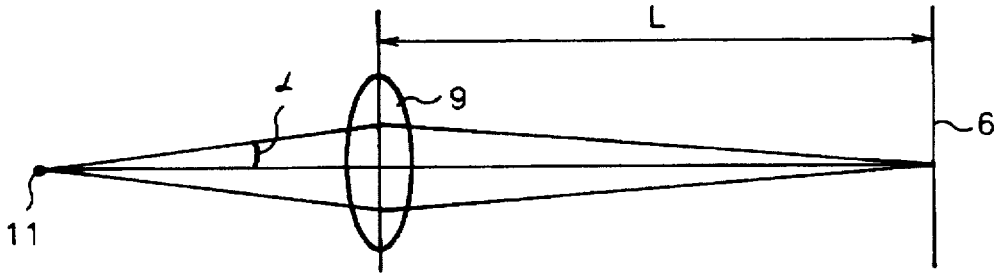
FIG.2 PRIOR ART
FIG. 2 shows a lens by the prior art electron gun.
Figure 3:
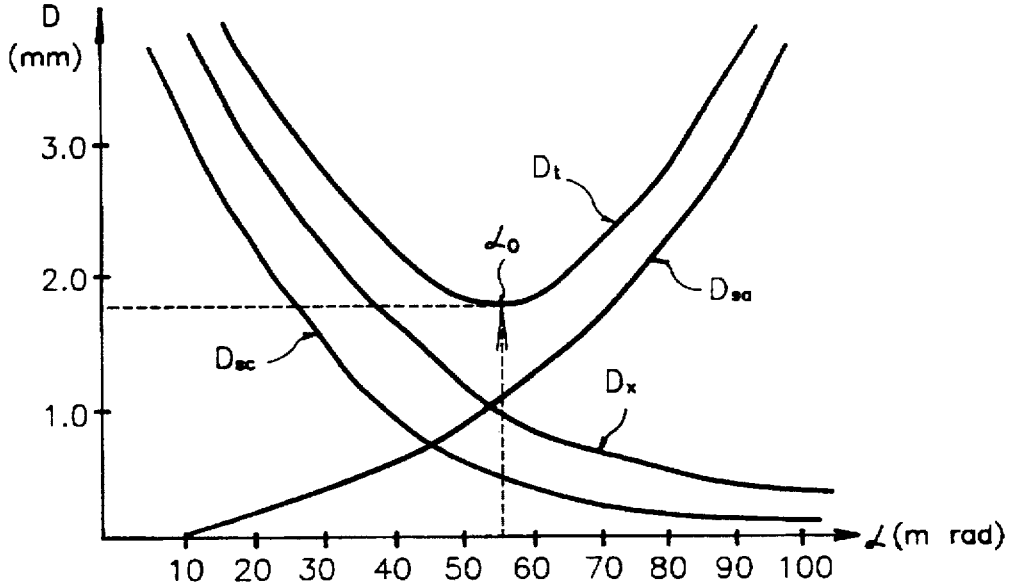
FIG.3 PRIOR ART
FIG. 3 shows a general way of calculation for an optimum divergence angle for a spot size.
Figure 4:
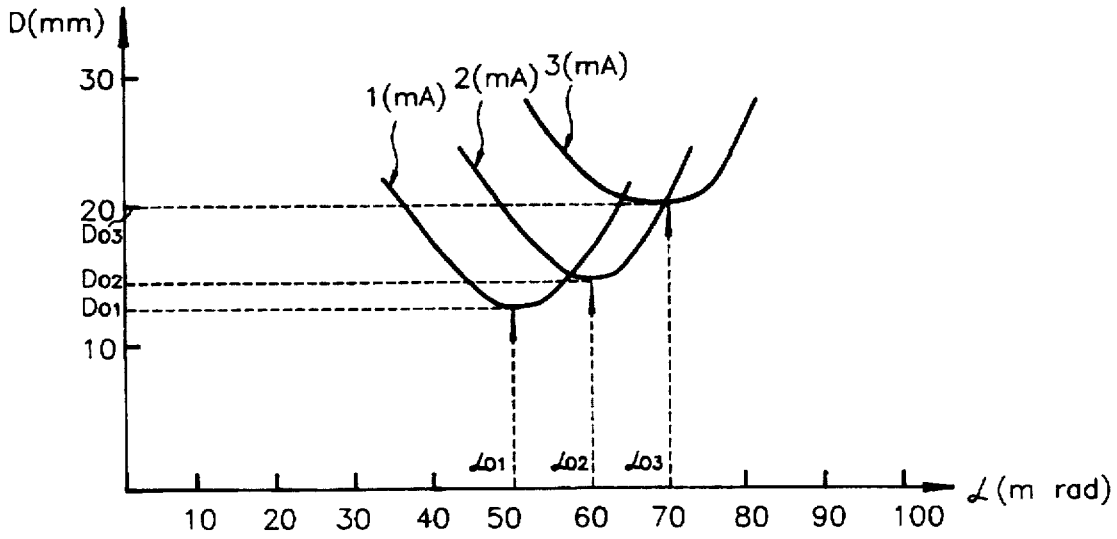
FIG.4 PRIOR ART
FIG. 4 shows a general way of calculation for an optimum angle as function of intensity of current.
Figure 5:
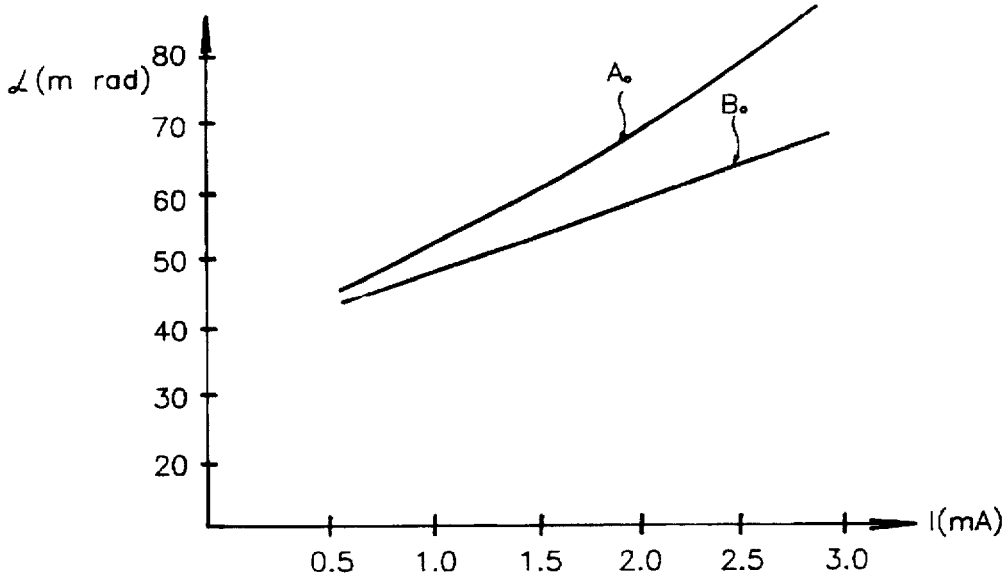
FIG.5 PRIOR ART
FIG. 5 shows divergence angle and optimum divergence angle as a function of intensity of current for the prior art electron gun.
Figure 6:
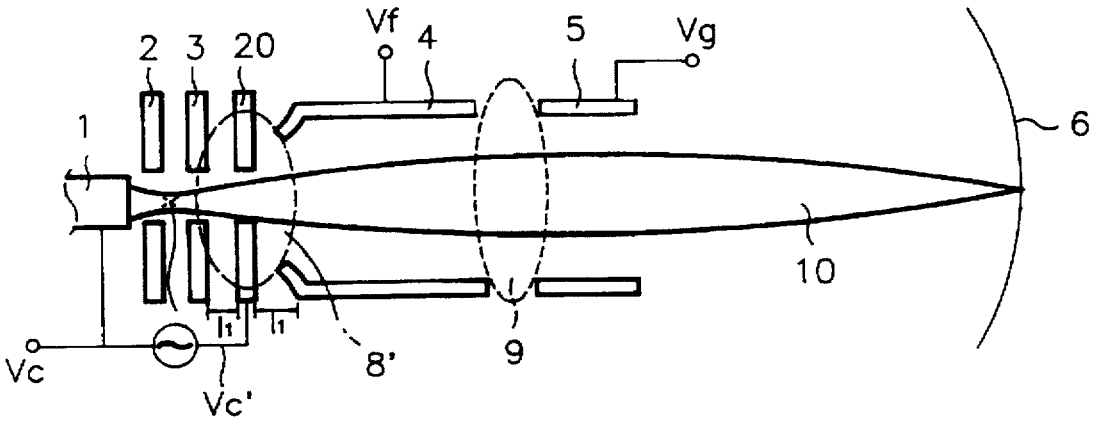
FIG. 6 is a section of a part of an electron gun in accordance with this invention.
Figure 6A:
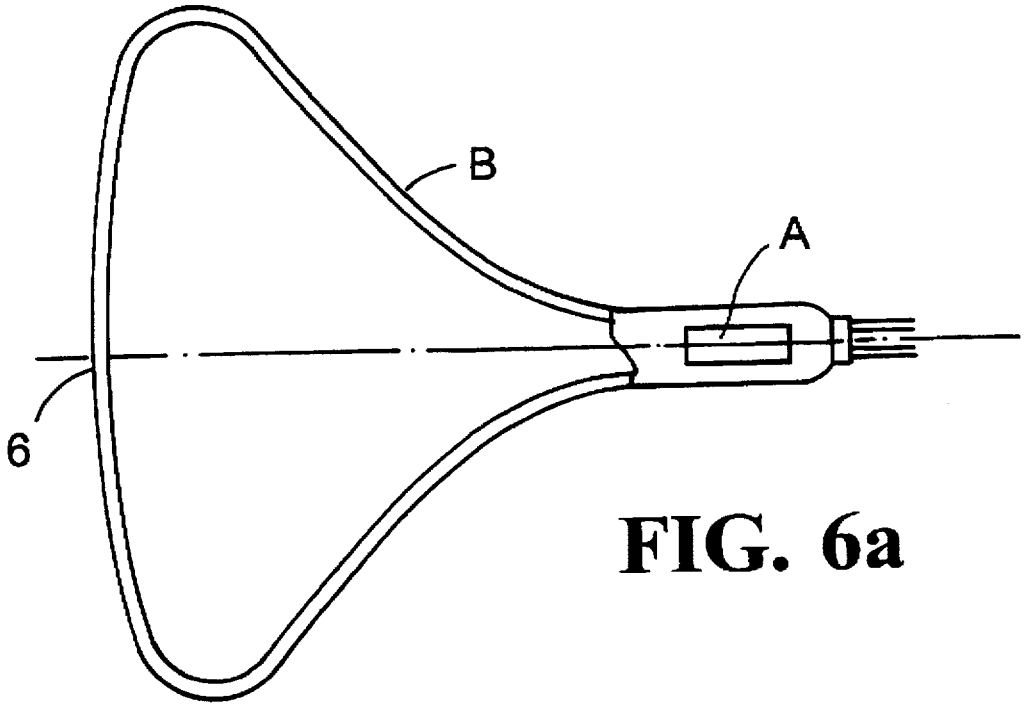
FIG. 6*a* is a partial sectional view of a color cathode ray tube in which the invention is mounted.
Figure 6B:
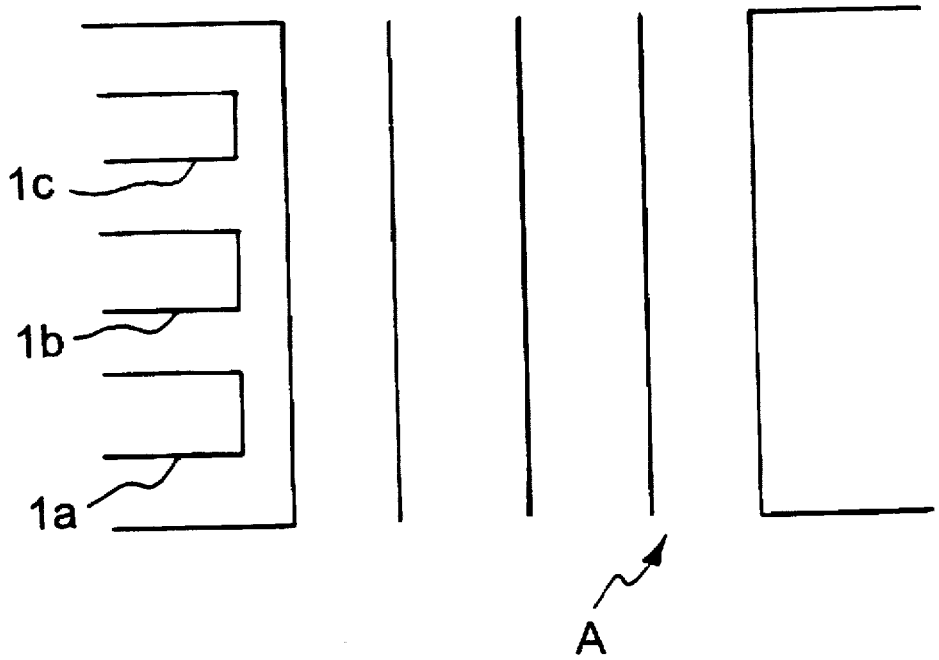
FIG. 6*b* is a schematic view of an electron gun in accordance with this invention.

FIG. 6 is a section of a part of an electron gun in accordance with this invention, wherein the electron gun includes a cathode 1 for emitting electron beams, a plurality of electrodes 2 to 5 for controlling, accelerating and focusing the emitted electron beams, and a supplementary electrode, i.e., a cathode dynamic electrode 20 of a fixed thickness t1 inserted between a first acceleration electrode 3 and a focusing electrode 4 with an aperture 11. FIG. 6*a* shows a partial sectional view of a color cathode ray tube B having a screen 6 and an electron gun A in accordance with this invention. FIG. 6*b* is a schematic view of an electron gun in accordance with this invention showing a plurality of cathodes 1 and a plurality of electrodes aligned in the direction of the electron beams emitted from cathodes 1*a*, 1*b* and 1*c*. The general orientation of the cathodes and electrodes forming the electron gun A within the color cathode ray B is in accordance with conventional practices in the prior art. The electron gun of this invention, as shown in FIG. 6, is operated by applying cathode dynamic voltage Vc' amplified through synchronizing to a cathode voltage Vc having an amplitude (amplitude of voltage) varying as a function of time from the cathode dynamic electrode 20.

Figure 7:
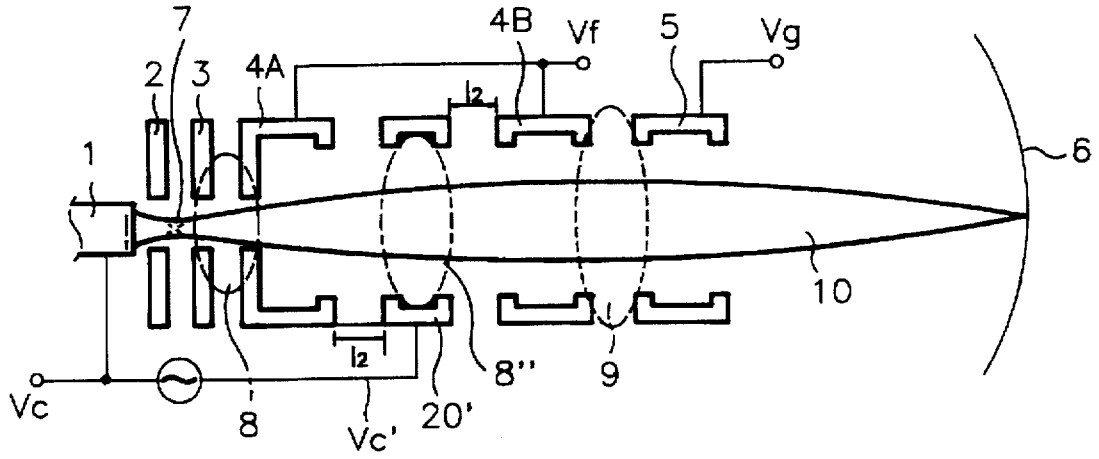
FIG. 7 is an electron gun in accordance with other embodiment of this invention.

FIG. 7 is an electron gun in accordance with other embodiment of this invention, wherein the electron gun includes a cathode dynamic electrode 20' of a fixed thickness t2 inserted between a first focusing electrode 4A and a second focusing electrode 4B with an aperture 12. The electron gun is also operated by applying cathode dynamic voltage Vc' amplified through synchronizing to a cathode voltage Vc having an amplitude (amplitude of voltage) varying as a function of time from a cathode dynamic electrode 20'.

Figure 8A:
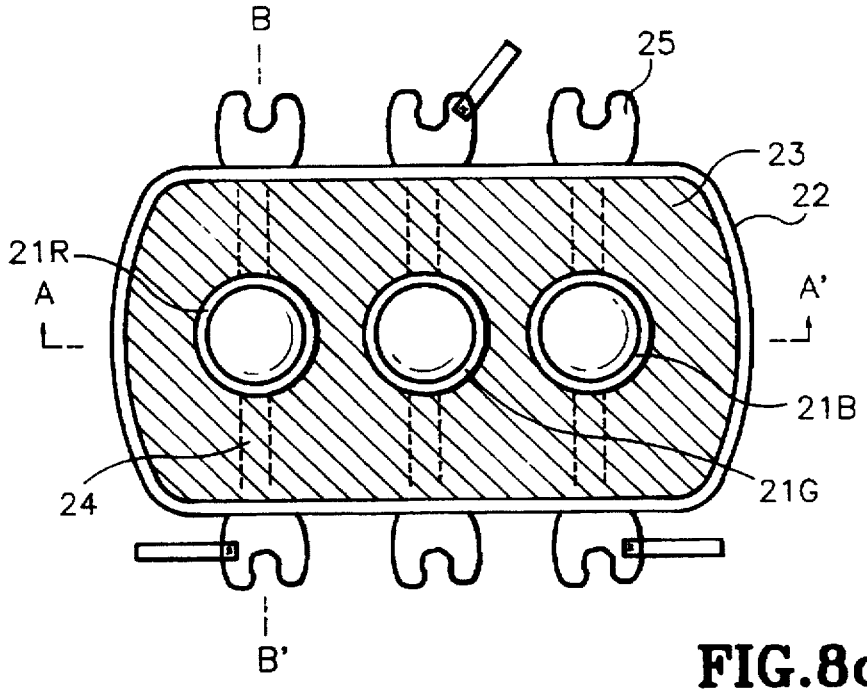
Figure 8B:
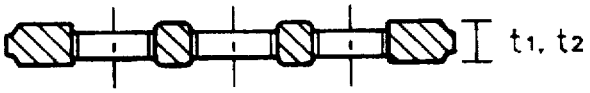
Figure 8C:
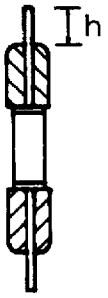

FIGS. 8*a* to 8*c* are detail of the cathode dynamic electrode of the electron gun in accordance with this invention, wherein, as shown in FIG. 8*a*, a space between the rims of three holes 21R, 21G and 21B and the rim of the electrode 22 is treated with ceramic metalizing treatment process to form a ceramic insulation part 23 (hatched part) for insulating the three holes 21R, 21G and 21B, electrically. And one lead 24 (dotted lines) is, buried in the ceramic part for insulating the lead lines from others, provided to each of the three holes 21R, 21G and 21B to apply power to the three holes 21R, 21G and 21B. To fix the cathode dynamic electrode described above to the electron gun aligned at a middle of two electrodes, a plurality of bead glass insertion part 25 are provided at top and bottom centered on each of the holes 21R, 21G and 21B as shown in FIG. 8*a*. And the insertion parts 25 are projected to a height h from the rim 22 of the electrode as shown in FIG. 8*c*.

Operation and advantages of this invention having the foregoing construction is to be explained hereinafter.

Figure 9:
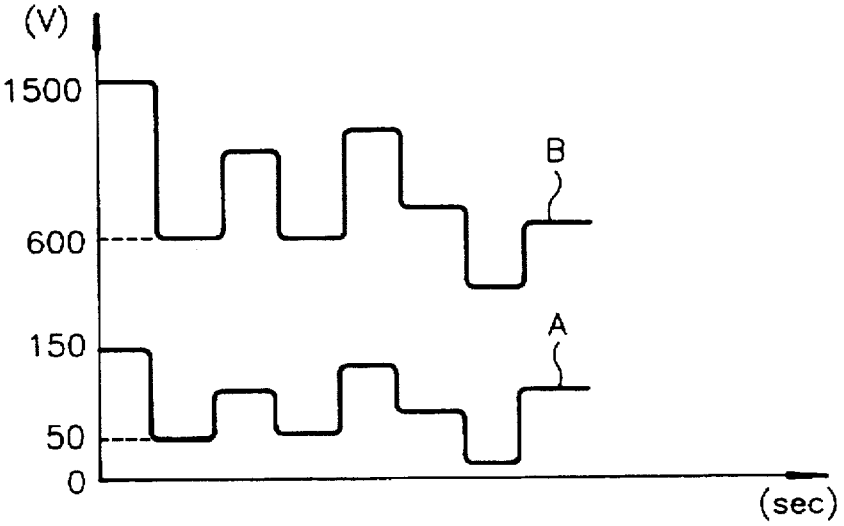
FIG. 9 shows voltage wave patterns as a function of time applied to the cathode dynamic electrode of the electron gun in accordance with this invention.

As shown in FIG. 9, the cathode voltage Vc having an amplitude (voltage amplitude) varying as function of time is amplified as B Vc', and synchronized to the cathode dynamic electrode 20 inserted between the first acceleration electrode 3 and the focusing electrode 4 of FIG. 6. Accordingly, an enlargement electrostatic lens 8' controllable and sensitive as a function of intensity of current positioned between the first acceleration electrode 3 and the focusing electrode 4, is formed.

Figure 10A:
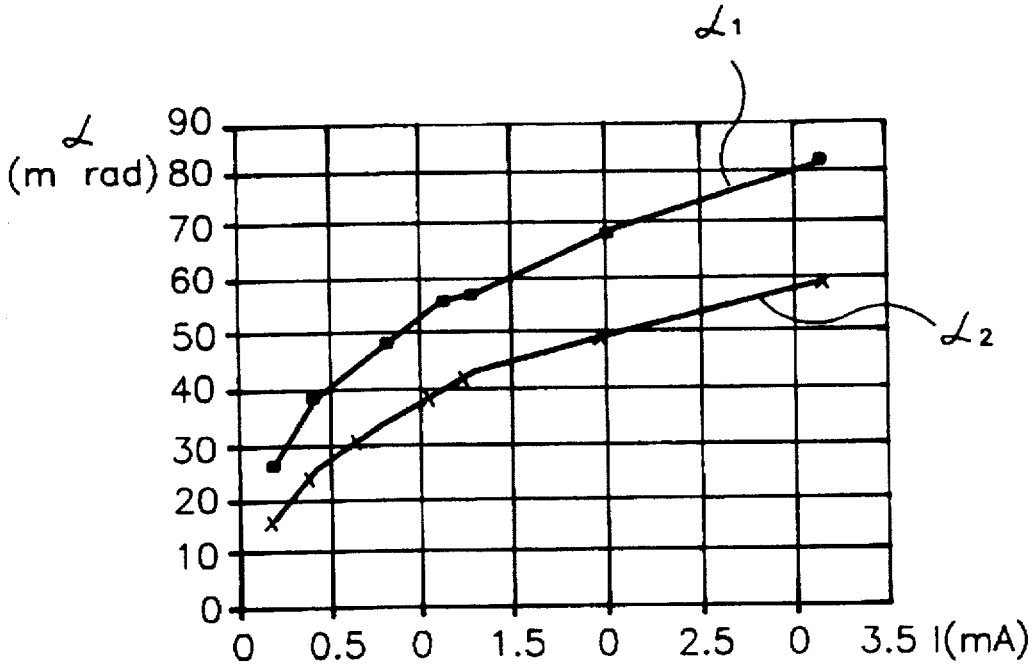

As shown in FIG. 10*a*, when the intensity of current is high, potential of the cathode is in general low and, since potential of the cathode dynamic electrode 20 being synchronized thereto becomes also lower subsequently, the enlargement electrostatic lens 8' becomes thicker and the divergence angle $\alpha$ of the electron beam becomes smaller. Opposite to above, when the intensity of current is low, the cathode potential becomes higher and, since the potential of the cathode dynamic electrode 20 being synchronized thereto becomes also higher subsequently, the enlargement electrostatic lens 8' becomes thinner and the divergence angle $\alpha$ of the electron beam becomes greater. In conclusion, a graph $\alpha_2$ for change of the divergence angle exhibiting comparatively less change compared to a graph $\alpha_1$ for change of the divergence angle of the prior art electron beam can be formed.

Figure 10B:
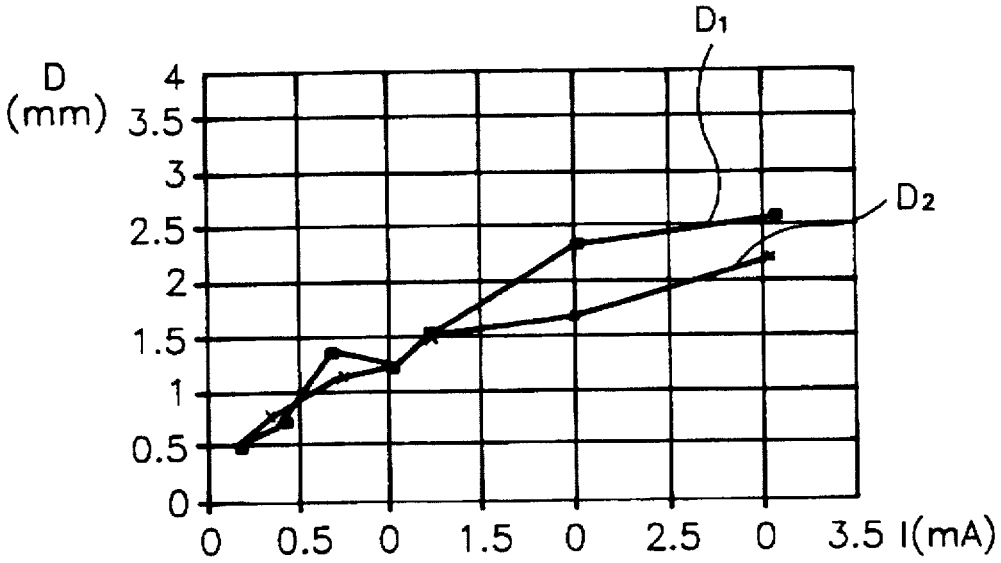

Owing to function of the enlargement electrostatic lens 8' described above enabling to direct electron beams to the main lens 9 with an optimum divergence angle for an intensity of current, a graph $D_2$ for change of the spot size exhibiting comparatively less change compared to a graph $D_1$ for change of the spot size is formed as shown in FIG. 10*b*. As such, by facilitating an appropriate control of the spot size closely affecting the resolution of a CRT, pixels, small and dense, can be reproduced.

Figure 11A:
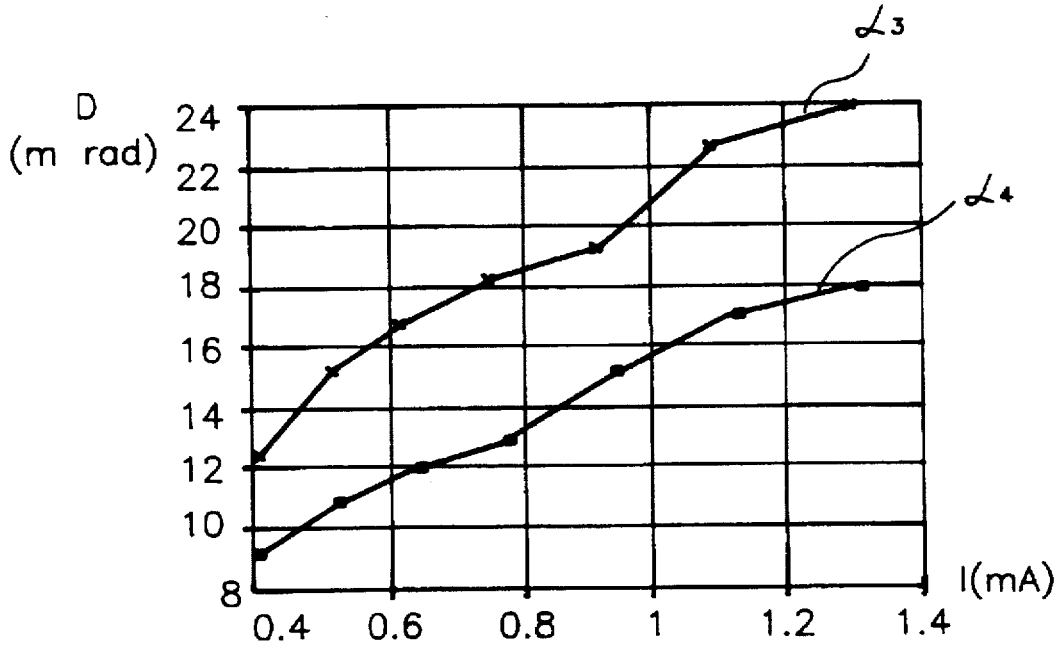

On the other hand, in the prior art electron gun having another electrode inserted between the first focusing electrode and the second focusing electrode, a fourth grid and the first acceleration electrode 3 have same potential to form a unipotential lens between the first focusing electrode and the second focusing electrode to focus the electron beam in multi-stage, primarily focused at the prefocusing lens 8 and direct the beam toward the main lens 30, thereby makes effect of astigmation to the minimum. However, in other embodiment of this invention shown in FIG. 7, the voltage Vc' applied to the cathode dynamic electrode 20' is synchronized to the cathode voltage Vc and amplified. Accordingly, as shown in FIG. 11*a*, when the intensity of current is high, since the voltage of the cathode dynamic electrode 20' synchronized thereto becomes lower, the enlargement electrostatic lens 8" becomes thicker and the divergence angle $\alpha$ of the electron beam is reduced. And, when the intensity of current is low, since the voltage of the cathode dynamic electrode 20' synchronized thereto becomes higher, the enlargement electrostatic lens 8" becomes thinner and the divergence angle $\alpha$ of the electron beam is increased. In conclusion, a graph $\alpha_4$ having comparatively less change of divergence angle compared to the graph of divergence angle $\alpha_3$ of the prior art electron beam can be formed.

Figure 11B:
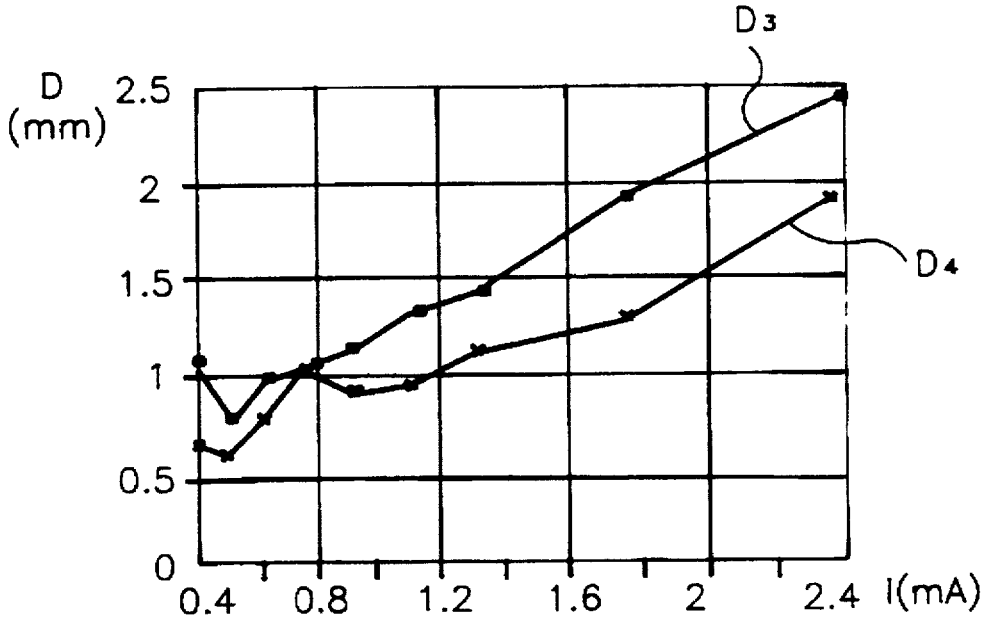

Owing to the function of the enlargement electrostatic lens 8" (forward focusing lens) which can direct electron beams to the main lens in an optimum divergence angle for a intensity of current, as shown in FIG. 11*b*, a graph for change of spot size D4 exhibiting comparatively less change compared to a prior art graph D3 for change of spot size can be formed. As such, this invention facilitates an appropriate control of the spot sizes which affect resolution of a CRT to a certain extent to reproduce small and dense pixels.

As has been explained, since this invention can provide spots having little change in size, and particularly can provide spots becoming smaller at high intensity of current, this invention has an advantage of improving the resolution of color picture tubes.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. An electron gun for a cathode ray tube comprising:

a three electrode part having a part formed of a plurality of inline electron beam emitting means for emitting electron beams and a part formed of control electrodes and acceleration electrodes for controlling a quantity of the emission and forming a crossover of the electron beams;

a plurality of focusing electrodes and acceleration electrodes forming a main electrostatic focusing lens for focusing the electron beam onto a screen, said electron beam emitting means and said plurality of electrodes being aligned in line with an axis of the cathode ray tube and spaced in a certain interval successively; and, a supplementary electrode having a fixed thickness and configured to receive a cathode dynamic voltage synchronized to a cathode signal, said supplementary electrode being positioned between an acceleration electrode and a focusing electrode to form an enlargement electrostatic lens for controlling a divergence angle of an electron beam according to the intensity of a current applied to the supplementary electrode.

2. The electron gun as claimed in claim 1, wherein the supplementary electrode has a tube shape and includes three electron beam pass through holes arranged inline for passing electron beams, an insulation part formed between rims of the holes and a rim of the electrode for insulating the rims of the holes and the rim of the electrode, and leads inserted in the insulation part for supplying power to each of the holes.

3. An electron gun for a cathode ray tube comprising:

a three electrode part having a part formed of a plurality of inline electron beam emitting means for emitting electron beams and the other part formed of control electrodes and acceleration electrodes for controlling the quantity of emission and forming a crossover of the electron beams;

a plurality of focusing electrodes and positive electrodes forming a main electrostatic focusing lenses for focusing the electron beam onto a screen, said electron beam emitting means and said plurality of electrodes being aligned in line with the tube axis spaced in a certain interval successively, and said plurality of focusing electrodes has a first focusing electrode and a second focusing electrode adjacent to the positive electrode for applying the same voltage; and, a fixed thickness supplementary electrode positioned between the first focusing electrode and the second focusing electrode synchronized to the application signal of the electron beam emission means.

* * * * *